US005332350A

United States Patent [19]

Hollrock et al.

[11] Patent Number: 5,332,350

[45] Date of Patent: Jul. 26, 1994

[54] GOLF BALL HANDLING SYSTEM

[75] Inventors: Richard H. Hollrock, Simsbury, Conn.; J. Richard Hollrock, South Deerfield, Mass.

[73] Assignee: Hollrock Engineering, Inc., Simsbury, Conn.

[21] Appl. No.: 995,023

[22] Filed: Dec. 15, 1992

[51] Int. Cl.[5] ..... B65G 69/00

[52] U.S. Cl. ..... 414/376; 414/434

[58] Field of Search ..... 414/376, 434, 437, 439, 414/440–443, 572

[56] References Cited

U.S. PATENT DOCUMENTS 3,209,928 10/1965 Osborne ..... 414/376 X 3,319,798 5/1967 Stevens ..... 414/376 X 4,221,524 9/1980 Morris ..... 414/439

4,735,544 4/1988 Stotts ..... 414/440

4,844,527 7/1989 Ray ..... 414/440 X

*Primary Examiner*—Chris K. Moore

*Attorney, Agent, or Firm*—McCormick, Paulding & Huber

[57] ABSTRACT

A driving range environment includes golf ball pickers to return the balls to a golf ball washer. The pickers are parked at a golf ball unload station where the balls are dropped through a grate onto a conveyor or chute for transport to the hopper of the ball washer. From the washer the balls travel through air filled tubes that dry the balls and transport the balls to dispensers where the golfer can again drive the balls at the range.

8 Claims, 1 Drawing Sheet

GOLF BALL HANDLING SYSTEM

This invention relates generally to golf ball handling systems, and deals more particularly with a system for picking up golf balls from a driving range environment, transporting the balls to a station where the balls are deposited in a hopper associated with a golf ball washer. The washed golf balls are then transported and dried by a golf ball transport mechanism into which the balls are gravity fed by the ball washer. The balls are conveyed through one or more conduits by air pressure and air movement from the outlet of the golf ball washer to the inlet or hopper of a golf ball dispenser.

CROSS REFERENCE TO RELATED APPLICATION

This application is copending with a commonly owned application Ser. No. 877,265, now U.S. Pat. No. 5,228,168, issued Jul. 20, 1993, and bearing the same title and filed by the inventors herein. Our prior application is incorporated by reference herein. U.S. Pat. Nos. 3,995,759 and 4,805,251 are also incorporated by reference herein.

BRIEF DESCRIPTION OF THE PRIOR ART

Golf ball pickers of the type adapted to pick up golf balls from a driving range or the like are well known. However, such pickers generally require removal of the golf balls from the picker by physically lifting baskets loaded with golf balls, from the picker and then manually transporting these baskets to a hopper associated with a golf ball washer. Golf ball washers are well known, but here again the balls most generally are manually discharged into another basket and they must be physically transported to a dryer or sorter or other system preparatory to loading the dried golf balls into a golf ball dispenser. Here again, the dispensers of golf balls are also known from the prior art, but the prior art does not show or suggest an integrated system of the type to be described herein that is capable of handling the golf balls in an automated fashion from the time they are picked up by the picker until they are dispensed for use by the golfer at the driving range to complete the cycle.

SUMMARY OF THE INVENTION

In accordance with the present invention a tractor or other device such as a golf cart can be used to manipulate one or more golf ball pickers around the golf driving range so as to pick up balls between rotating discs in accordance with the teaching of U.S. Pat. No. 3,995,759 for example. Such pickers generally have baskets which store the balls picked up by the rotating discs until the picker can be driven to a place where the baskets are removed from the picker and the golf balls dumped into another hopper, usually one associated with a golf ball washer.

In accordance with the present invention improved pickers are provided with baskets having trap doors provided on the bottoms of the baskets such that golf balls can be conveniently dumped at an unload station and from there conveyed to the hopper of the golf ball washer. This unload station may simply comprise a raised ramp where the picker is driven onto a grate with openings such that the dumped golf balls pass through the grate openings when the trap doors of the basket are opened. Means is provided for funnelling the balls onto a conveyor or into a chute such that the balls can be deposited in the hopper associated with the ball washer. In our copending application Ser. No. 877,265, cited previously applicants disclose a system for further handling of the washed golf balls such that they can be conveyed to one or more golf ball dispensers. That prior application Ser. No. 877,265 is incorporated herein by reference.

BRIEF DESCRIPTION OF THE DRAWINGS

FIG. 1 is an elevational view illustrating in somewhat schematic fashion the relationship between the golf ball pickers parked at the ball unloading station such that golf balls retrieved from the driving range can be funnelled and conveyed to the hopper of a golf ball washer. This view also shows the golf ball transport mechanism of our copending application for conveying and drying the washed balls to one or more golf ball dispensers.

DETAILED DESCRIPTION OF FIRST EMBODIMENT

Figure 2:
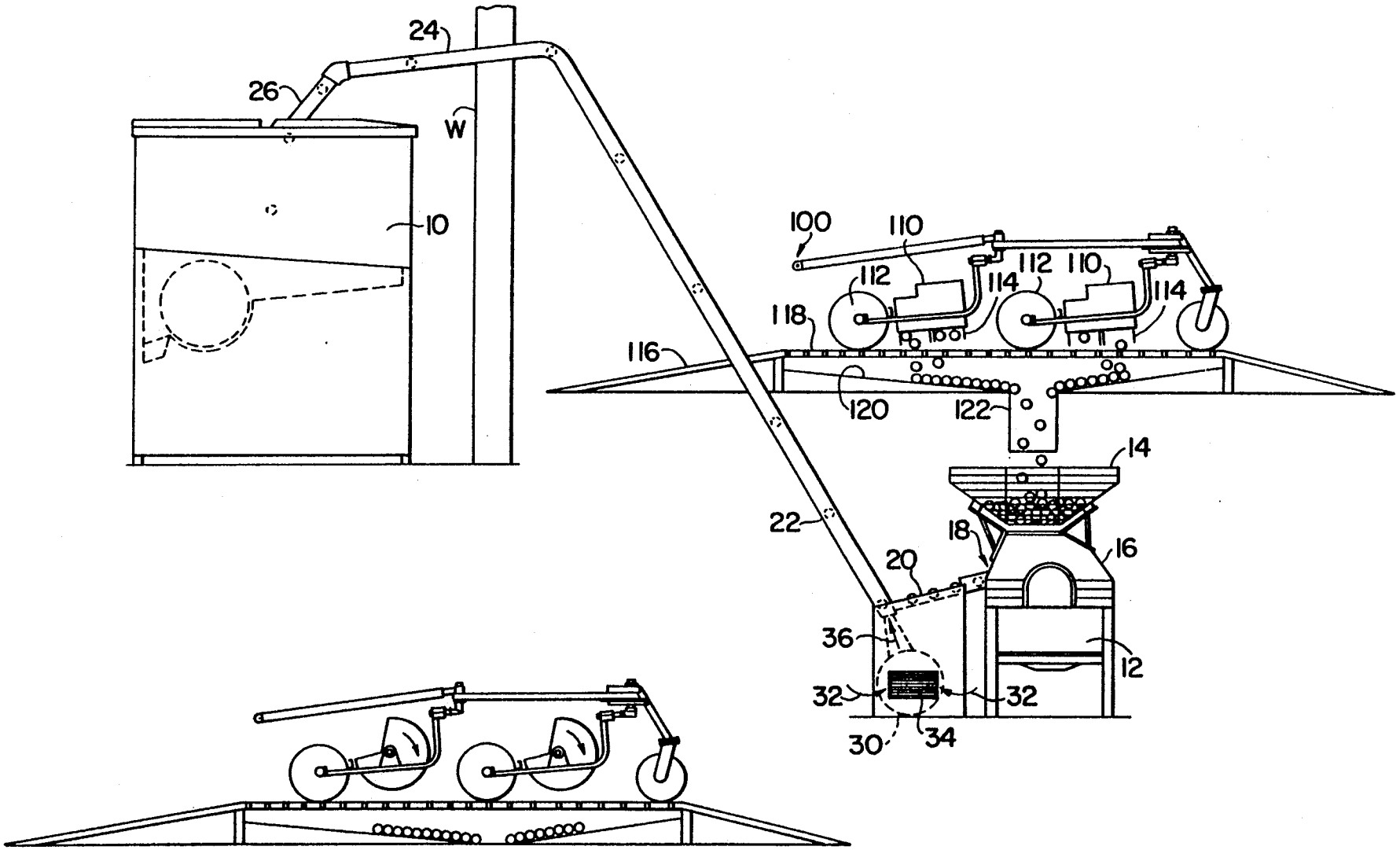
FIG. 2 shows an alternative embodiment wherein the golf ball pickers have receptacles that can be tilted to dump positions.

Turning now to FIG. 1 in greater detail, a golf ball dispenser 10 is provided on one side of a wall W, and represents several such dispensers that might be provided in spaced relationship along this wall in a typical driving range environment. Out of sight behind the wall W a conventional ball washer 12 is provided for washing the balls prior to delivery of the balls to the dispensers. Such a ball washer might take the form as described and shown in U.S. Pat. No. 4,805,251. The disclosure in this prior art ball washer is incorporated by reference herein, but any conventional ball washer might be substituted for that indicated generally at 12 without departing from the scope of the present invention. Typically, such a ball washer includes a hopper 14 provided above a tank 16, and inside the tank a rotating brush is provided for driving the golf balls around one or more generally helical paths from an inlet and associated with the hopper 14 to an outlet indicated generally at 18 in FIG. 1. The balls, after being washed, are still quite wet from the washing operation as they move by gravity down an inclined chute indicated generally at 20.

In accordance with the invention disclosed in our copending application Ser. No. 877,265 filed Apr. 28, 1992 the wet balls are transported by a golf ball transport mechanism comprising conduits 22, 24 and 26. These conduits may be double conduits to match the double helical paths followed by the golf balls in our ball washer. So too, the outlet chute 20 associated with the ball washer 12 may comprise side-by-side tracks.

The golf ball transport mechanism shown in FIG. 1 is also described in our copending application Ser. No. 877,265, filed Apr. 28, 1992 and includes air moving means, preferably in the form of a blower 30, which receives ambient air as suggested by the arrows 32, 32. The air is drawn through the inlet 34 by the blower and exhausted upwardly as suggested generally by the arrow 36 to provide a continuous stream of air through the conduits 22, 24 and 26. The blower can be operated whenever the ball washer is operated.

The golf ball transport mechanism not only serves to deliver the washed golf balls from the washer 12 to the dispenser 10, but also serves to dry the balls while they are moving from the washer to the dispenser as a result of the air flow generated by the blower system 30.

The golf ball dispenser need not be described in detail herein, and the reader is referred to our copending application Ser. No. 877,265, filed Apr. 28, 1992 for a detailed description thereof. The disclosure of that copending application has been incorporated by reference herein.

Still with reference to our prior copending application Ser. No. 877,265, we have found it advantageous to provide means for disrupting the air flow around the ball which is entering the conduit 22 at its upstream end of the conduit. Preferably said means comprises a generally tubular sleeve provided inside the conduit and having an inside diameter of approximately equal to the outside diameter of the golf balls. Said flow disrupting means further comprises a ramp shaped insert secured to the side wall of the conduit means and extending radially inwardly of the conduit side wall. The ramp defining means includes a portion extending upwardly into the means for feeding the golf ball into the load station, and said means for feeding golf balls into the load station comprises an inclined chute oriented at an angle with respect to the conduit means. We have described this means for disrupting the inherently symmetrical flow of air around the golf ball at inlet or upstream end of the conduit in said application Ser. No. 877,265, filed Apr. 28, 1992.

In accordance with the present invention we have combined the aforesaid features of our prior copending application with the further feature of providing for the expeditious delivery of golf balls to the ball washer. In accordance with the present invention a tractor or golf cart of the type which is adapted to manipulate conventional golf pickers around a driving range is connected to the pickers shown in FIG. 1 as indicated generally at 100. Two pickers are shown in tandem in FIG. 1 but one picker might be used in accordance with the present invention and still realize the advantages of the present invention. The pickers are of conventional configuration except for the fact that the baskets 110 provided for receiving the golf balls picked up by the rotating discs 112 are provided with trap doors 114 in the bottom wall thereof, which trap doors can be selectively opened to release golf balls when the pickers are provided at the golf ball unload station shown in FIG. 1. The unload station comprises a raised ramp 116 that can be used to provide sufficient clearance so that the trap doors can be opened. The balls drop by gravity through grate openings in a grating surface 118 associated with the ramp 116. Beneath the grate a funnel shaped surface 120 is provided to direct the golf balls onto a central conveyor or chute 122. The conveyor or chute 122 carries the golf balls to the upwardly open hopper 14 of the ball washer 12.

The golf ball pickers themselves are of conventional configuration as mentioned previously except for the fact that the baskets 110 have trap doors 114 in the bottom to provide for a convenient method of unloading the golf balls and for dropping the golf balls through the grating surface 118 into the funnelling system 120 for transport via the conveyor or chute 122 into the ball washer 12. The reader is referred to our prior issued U.S. Pat. No. 3,995,759 for a more complete description of a typical golf ball picker.

DETAILED DESCRIPTION OF ALTERNATIVE EMBODIMENT

FIG. 2 shows a modified golf ball picker wherein the generally rectangular receptacles or baskets are replaced by cylindrical containers having open tops for receiving the gathered balls. Instead of providing pivoted trap doors in the bottom of these receptacles we prefer to provide mounts for the cylindrically shaped receptacles of FIG. 2 so they can be pivoted or tilted to dump the balls.

We claim:

1. A golf ball handling system comprising:

mobile means for gathering golf balls at a driving range or the like, said mobile means including golf ball receptacle means adapted to store golf balls that are so gathered, said receptacle means having an opening through which golf balls are gravity fed, means defining a golf ball unload station, said unload station having means for receiving golf balls gravity fed from said golf ball receptacle means associated with said mobile golf ball gathering means, golf ball storage means including a hopper for accepting golf balls from said unload station.

2. The combination of claim 1 further characterized by golf ball transport means, and including a conduit and air moving means coupled to said conduit for moving the balls inside the conduit from said golf ball storage means.

3. The combination according to claim 2 further characterized by a golf ball dispenser for receiving the balls from said conduit and providing selective release of a predetermined number of said balls at a golf ball dispensing station in said golf ball dispenser.

4. The combination according to claim 1 wherein said unload station includes an inclined ramp to facilitate the movement of said mobile means into said unload station, and said unload station including a grated surface with grate openings such that the golf balls gravity fed from said golf ball receptacle means pass through the grate openings, and means for directing the golf balls passing through said grate openings to said golf ball storage means.

5. The combination according to claim 4 wherein said means for directing golf balls after they drop through said grate openings comprises a conveyor located below said golf ball receiving means.

6. A golf ball handling system comprising mobile golf ball pickers for gathering balls at a golf range, means defining a golf ball unload station, said pickers having receptacles with openings for gravity feeding balls at said load station, and means for transporting golf balls out of said unload station.

7. The combination according to claim 6 wherein said receptacles have movable doors for closing said openings.

8. The combination according to claim 7 further characterized by means for tilting said receptacles to a dump position to provide said openings in position to drop the balls for gravity feeding.

* * * * *

UNITED STATES PATENT AND TRADEMARK OFFICE

CERTIFICATE OF CORRECTION

PATENT NO. : 5,332,350
DATED : July 26, 1994
INVENTOR(S) : Richard H. Hollrock and J. Richard Hollrock It is certified that error appears in the above-identified patent and that said Letters Patent is hereby corrected as shown below:

Column 4, claim 8,
Line 60, after the word "claim", delete [7] and substitute -- 6 --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*